US006332390B1

(12) United States Patent
Lyons

(10) Patent No.: US 6,332,390 B1
(45) Date of Patent: Dec. 25, 2001

(54) CERAMIC TILE ARMOR WITH ENHANCED JOINT AND EDGE PROTECTION

(75) Inventor: F. Stanton Lyons, Phoenix, AZ (US)

(73) Assignee: Simula, Inc., Phoenix, AZ (US)

( * ) Notice: Subject to any disclaimer, the term of this patent is extended or adjusted under 35 U.S.C. 154(b) by 0 days.

(21) Appl. No.: 09/475,192

(22) Filed: Dec. 30, 1999

Related U.S. Application Data

(62) Division of application No. 08/895,774, filed on Jul. 17, 1997, now Pat. No. 6,009,789.

(60) Provisional application No. 60/045,281, filed on May 1, 1997.

(51) Int. Cl.[7] ..... F41H 5/04; F41H 1/02

(52) U.S. Cl. ..... 89/36.02; 89/36.05; 89/36.08; 2/2.5

(58) Field of Search ..... 89/36.02, 36.05, 89/36.08; 109/49.5; 2/2.5; 428/911

(56) References Cited

U.S. PATENT DOCUMENTS

| | | | | |
|---|---|---|---|---|
| H1434 | | 5/1995 | Cytron | 89/36.02 |
| 2,718,829 | | 9/1955 | Seymour et al. . | |
| 3,592,942 | | 7/1971 | Hauck et al. . | |
| 3,683,828 | | 8/1972 | Alliegro et al. | 109/83 |
| 3,859,892 | | 1/1975 | Coes | 109/80 |
| 3,867,239 | | 2/1975 | Alesi et al. . | |
| 3,873,998 | * | 4/1975 | Norris et al. | 2/2.5 |
| 4,757,742 | | 7/1988 | Mazelksy | 89/36.02 |
| 5,533,781 | * | 7/1996 | Williams | 89/36.08 |
| 5,556,601 | * | 9/1996 | Huvey et al. | 156/172 |
| 5,686,689 | | 11/1997 | Snedeker et al. | 89/36.02 |
| 5,705,764 | | 1/1998 | Schade et al. | 89/36.02 |
| 6,009,789 | * | 1/2000 | Lyons | 89/36.02 |

FOREIGN PATENT DOCUMENTS

| | | | |
|---|---|---|---|
| 1151441 | 5/1969 | (GB) | 89/36.02 |

OTHER PUBLICATIONS

Kevlar Aramid, "Lightweight protective armor of Kevlar aramid" by Dupont, pp. 1–6, sections entitled: "Kevlar aramid—A superior option for lightweight protective armor," "Advantages of Kevlar aramid fibers," and "Structural composite armor of Kevlar aramid."

* cited by examiner

*Primary Examiner*—Stephen M. Johnson
(74) *Attorney, Agent, or Firm*—Shaw Pittman LLP

(57) ABSTRACT

A ceramic composite tile armor which is reinforced at the more vulnerable joint and free edge areas, using glass or ceramic strips or overlays bonded with an adhesive to the outer surface of the tile joints and free edges. This reinforcement provides improved ballistic threat protection for ground vehicle, aircraft, watercraft, spacecraft, and body (personnel) ceramic tile armor applications. Glass or ceramic overlay strips assist in fracturing impacting projectiles that strike the tile joints or free edges. The substrate laminate backing can then capture fragments of the projectile and broken ceramic and prevent penetration. The invention provides improved protection over conventional joint and edge enhancements with higher reliability of accurate positioning over joint and free-edge areas, with less added weight, and at lower associated production costs.

26 Claims, 4 Drawing Sheets

CERAMIC TILE ARMOR WITH ENHANCED JOINT AND EDGE PROTECTION

This application is a divisional of copending application Ser. No. 08/895,774, now U.S. Pat. No. 6,009,789 entitled "Ceramic Tile Armor with Enhanced Joint and Edge Protection," by F. Stanton Lyons, filed Jul. 17, 1997, (which claims the benefit of the earlier filing date of U.S. Provisional Application Serial No. 60/045,281 filed May 1, 1997 now abandoned) which is assigned to the assignee of the present invention and is hereby incorporated by reference. Accordingly, the present invention claims the benefit of the filing date of that earlier filed application.

BACKGROUND

1. Field of the Invention

The present invention relates to ceramic and ceramic matrix composite (CMC) tile armor, and specifically to armor that has reinforcement of the joints and free edges of the armor with glass or ceramic strips. These strips, according to the invention, are applied over the ceramic armor joints and edges and thereby increase the armor's ability to withstand a variety of ballistic threats. The purpose of this invention is to provide optimal armor protection capability for ground vehicles, watercraft, aircraft, spacecraft and, in body armor applications, for personnel.

2. Background of the Invention

Lightweight, composite ceramic tile armor has proven an effective countermeasure against a variety of ballistic threats including lead core, steel core, armor-piercing rounds, and fragments. However, it is also known that the protective value of ceramic armor progressively degrades as impact points approach the edges, corners, and abutting joints between individual tiles. Typically, in the case of a 6 inch×6 inch tile, as much as 60 percent of the tile's area could provide substandard ballistic protection in comparison to protection afforded against impact at the tile's center. In a 12 inch×12 inch tile, as much as 30 percent of the tile's area could be substandard, and in the case of a 15 inch×15 inch tile, as much as 20 percent. As a consequence, larger tile configurations are being used as one method of reducing the joints areas and increasing the overall percentage of tile performing optimally in any given arrangement. Additionally, vulnerable joint and free-edge areas typically are cut, pressed, or ground at substantially greater thicknesses (an approach known as the "raised edge" enhancement) in an effort to counteract the inherently weaker performance characteristics of these areas.

These improvements, however, have limitations. Large individual tiles are not adaptable to as great an arrangement of surface configurations as are small tiles. Large tiles also exhibit a greater degree of crack propagation, particularly after multiple hits, than smaller tile segments which are separated within the seams of the abutting joints by adhesive or flexible rubber strips. As a result of this increased crack propagation, a greater percentage of the overall armor is therefore damaged than would be the case with smaller tiles. Raised-edge enhancements improve the tile's protective performance, but are more difficult and costly to manufacture than flat, constant-thickness tiles.

Three U.S. patents, described below, illustrate methods for providing improved free edge or joint protection without encountering the disadvantages associated with the use of large tile and raised-edge enhancements. U.S. Pat. No. 3,859,892 discloses ceramic composite tile armor having a free edge, in which improved performance against high-energy projectiles at the free edge is achieved if the glass laminate backing is folded over at an angle of substantially 90 degrees and bonded along the side of the exposed edge to create an enclosing lip or flange. In another embodiment disclosed in this patent, improved ballistic performance is achieved by folding back the laminate at an angle of substantially 180 degrees along the length of the edge and then bonding the laminate to itself. U.S. Pat. No. 3,592,942 discloses improved free-edge protection employing a similar method of folding at an angle of substantially 90 degrees to create an enclosing lip or flange, but describes aluminum alloy, rather than glass laminate, as the preferred backing material. Both these improvements, however, are limited solely to the protection of the free edges of ceramic composite tile armor. They cannot be applied to the similarly vulnerable corners and abutting joints between individual ceramic armor tiles. U.S. Pat. No. 3,683,828 discloses improved ballistic protection at the free edges and at the joints between ceramic composite tiles through the placement of carbon steel, alloy steels, or titanium strips directly under the free edges and joints. The metallic strips are set along the entire length of all free edges and joints, and bonded with an adhesive between the outer layer of ceramic tile and the underlying layers of laminate fibrous backing. This enhancement is effective in improving ballistic protection, but is both costly and difficult to manufacture. Furthermore, indentations precisely corresponding to the length, width, and thickness of the metallic strips must be made in the laminate fibrous backing before the strips themselves are applied and the ceramic tiles set and adhered over them. Once the ceramic tiles are in place, there is no cost-effective method to assure that the metallic strips remain placed as intended as the entire armor assembly is cured.

SUMMARY OF THE INVENTION

The present invention is a ceramic composite tile armor which employs overlay strips in its construction to reinforce the joint and free-edge areas of the tile and, thereby, increase the protective capability of the armor. The armor is comprised of a laminate backing, ceramic tile, glass or ceramic overlay strips, and a spall shield. These components are bonded together with a resin adhesive.

The effectiveness of the invention relies on the principle that glass or ceramic of sufficient hardness and thickness will contribute to shattering an impacting projectile of lesser hardness. When a ballistic projectile impacts the ceramic tile armor at a protected joint or free edge, the glass or ceramic of the overlay strip of the present invention initiates fracturing of the impacting projectile before it contacts the underlying ceramic tile, where it is further broken into smaller fragments. The laminate behind the tile is then able, through a process of delamination and spreading, to absorb the conical shock wave pattern imparted by the fractured projectile. The fibers of the laminate capture and retain the fractured pieces of the projectile, as well as fragments of the shattered ceramic and overlay strip, and thereby prevent further penetration.

The invention overcomes the limitations of the prior art and existing armor by providing improved protection both to the joint and free-edge areas of ceramic tile armor with a minimal increase in weight. The invention is an improved ceramic tile armor which may be utilized for defense against a wide variety of ballistic threats. The reinforcement of the invention is applied to both joint areas and free-edge areas with relative ease, and at production costs lower than those associated with most conventional ceramic armor joint or free-edge enhancements.

Accordingly, it is an object of the present invention to provide optimum protection against ballistic threats to personnel, ground vehicles, watercraft, aircraft, and spacecraft.

Another object of the invention is to provide ceramic tile armor which includes both joint and free-edge area reinforcement.

It is a further object of the invention to provide armor joint and free-edge reinforcement with a minimal increase in weight to the overall armor configuration.

Another object of the invention is to provide ceramic tile armor with joint and free-edge protection at higher reliability and lower production costs than those associated with prior art methods.

DETAILED DESCRIPTION OF PREFERRED EMBODIMENTS OF THE INVENTION

Figure 1:
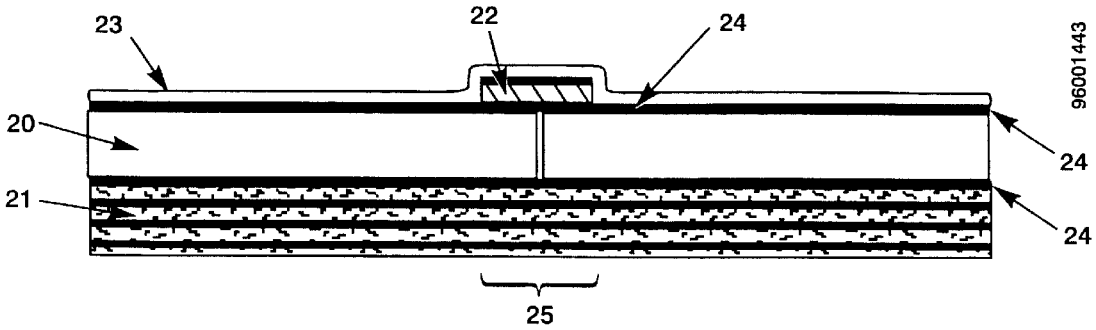
FIG. 1 is a schematic diagram of a cross-section of the composite ceramic tile armor showing the glass or ceramic overlay strip bonded over a joint area between tiles.
Figure 2:
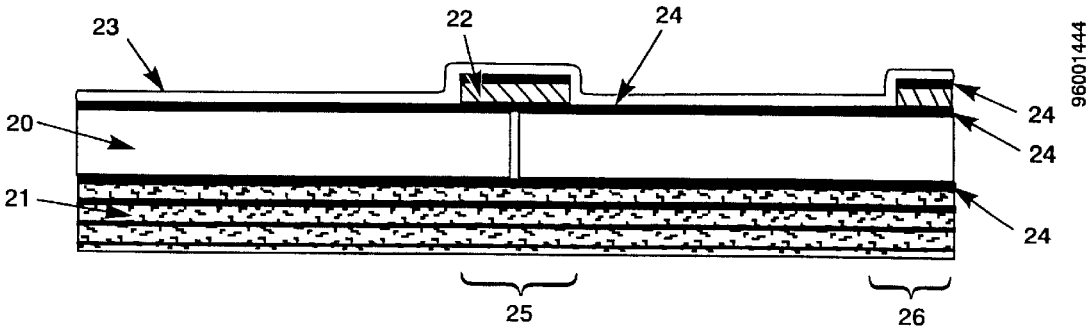
FIG. 2 is a schematic diagram of a cross-section of the composite ceramic tile armor showing the glass or ceramic overlay strips bonded over both a joint area between tiles and a free edge area.

The construction of the preferred embodiment of the ceramic tile armor is shown in FIGS. 1 and 2. Ceramic tile 20 is bonded to a laminate backing 21, and strips 22 of glass or ceramic are bonded to a joint area 25 and a free-edge area 26 of the ceramic tile 20. A spall shield 23 is bonded over the tile 20 and strips 22. The components are bonded together using a resin adhesive 24.

The ceramic tile 20 is preferably made of aluminum oxide, silicon carbide, or boron carbide depending on the weight, performance, and cost requirements involved. Other suitable tile materials include ceramic matrix composites (CMCs) such as silicon carbide/aluminum, which may provide improved multi-hit resistance due to their higher fracture toughness. The laminate backing 21 is preferably composed of a fiberglass, aramid, or polyethylene fiber-reinforced laminate with a polyester, vinylester, epoxy, phenolic, or other resin matrix component, and is produced in a manner typical of laminate construction. Preferred materials for the overlay strips 22 are borosilicate or soda lime glass, or ceramic of aluminum oxide, silicon carbide, or boron carbide. Preferably, the spall shield layer 23 is composed of nylon fabric, aramid, or urethane resin film, depending on the specific application and operating environment for the armor. The armor components are bonded preferably using a urethane adhesive 24. Other adhesives which may be used include epoxies and polysulfides.

The composite backing 21 is laminated either by using a wet lay-up technique or by using material which has previously been impregnated with a specific amount of resin (material known as "prepreg"). In the wet lay-up technique, fabric is laid out and an appropriate amount of resin is spread uniformly over the surface, saturating the fabric. Subsequent fabric layers are spread over those below and the requisite amount of resin added in the same manner. When the appropriate number of plies has been built up to achieve the desired backing thickness and design, the entire assembly is cured. Typically, curing is done using either a hot platen press or an autoclave which will apply the appropriate temperature and pressure cure cycle recommended for the particular resin system used. Prepreg material is easier to work with in that the fabric is pre-impregnated with a specified amount of resin. Prepreg layers are spread out and the panel consolidated and cured in the manner described above. The final resin content of the completed backing is determined based on the resin content of each of its prepreg layers.

Once the laminate backing 21 has been consolidated into a rigid composite, the appropriate ceramic or CMC tiles 20 are bonded in place over the composite. The type and dimensions of the tile 20 will depend on the armor configuration, threat, and multi-hit requirements for the armor. The type of adhesive 24 used to bond the tile 20 to the backing 21, as well as that used to bond the overlay strips 22 and spall shield 23 to the tile, will depend on the ballistic, structural, and environmental requirements for the armor. Preferably, the tile 20 is arranged in an offset array similar to a brick-layer's pattern, wherein a maximum of three tile corners or edges meet to create a joint. Testing has shown that ceramic composite armor provides increasingly greater protection as the number of joints in any given configuration, which are inherently vulnerable, is decreased.

The tile 20 are bonded to the backing 21 using the appropriate cure cycle for the selected adhesive 24. The protective overlay strips 22 are preferably positioned and bonded over the joint seams 25 and free edges 26 of the tile during this same bonding process. The positioning of the overlay strips 22 can be maintained throughout the curing process by using a template. Preferably, the resulting tile armor configuration is vacuum bagged throughout the curing process to apply constant pressure on the panel and help ensure a uniform bond line.

Figure 3:
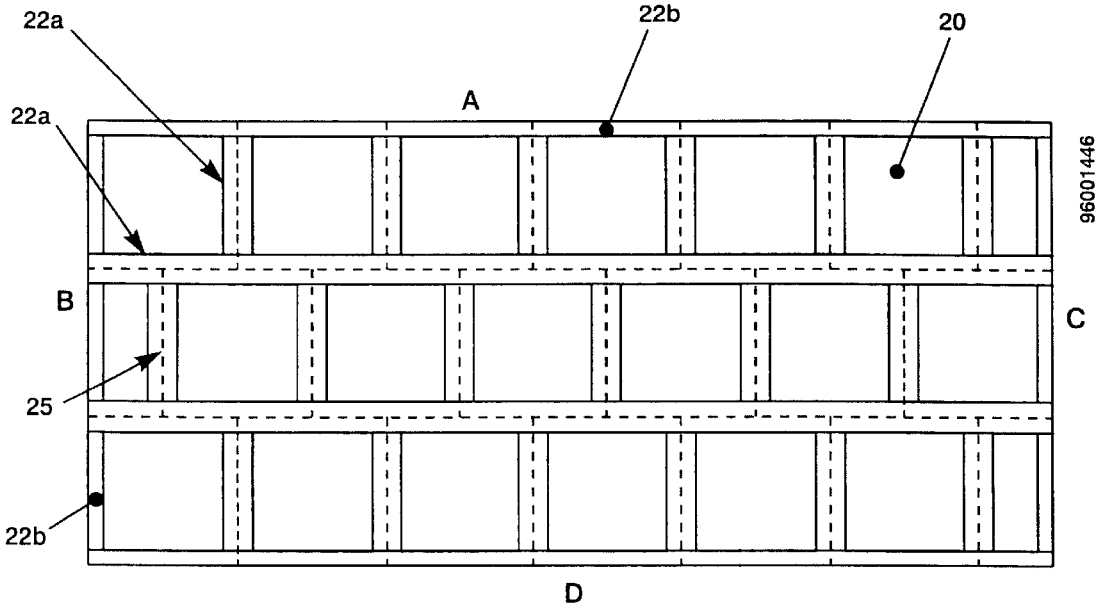
FIG. 3 is a plan view of individual glass or ceramic overlay strips positioned and bonded to the joint and free-edge areas of a conventional tile armor configuration.
Figure 4:
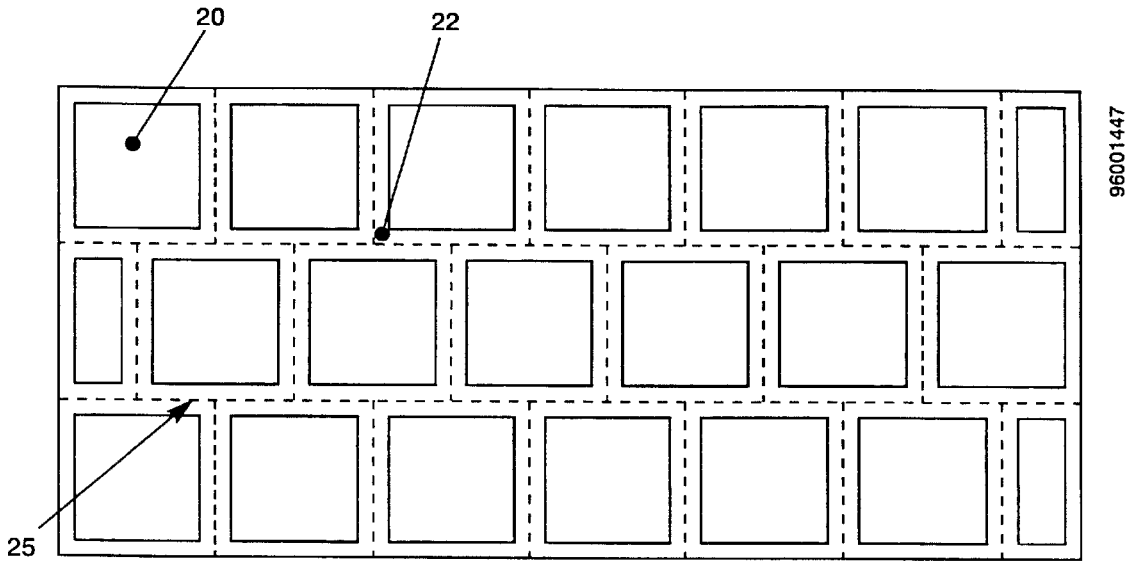
FIG. 4 is a plan view of a unitary glass or ceramic overlay positioned and bonded to a conventional tile armor configuration.

The overlay strips 22 may be applied either as individual lengths, as shown in FIG. 3, or as a unitary reinforcement frame designed to cover a specific tile configuration, as shown in FIG. 4. Individual strips can be purchased from the manufacturer in the desired dimensions, or purchased in longer sections and cut to length prior to assembly. Likewise, the unitary reinforcement frame may be purchased pre-cut from the manufacturer, or may be cut to size prior to assembly using either a diamond-edge saw or water jet.

The spall shield 23 may either be bonded to the armor at the same time as the tile 20, laminate backing 21, and overlay strips 22 are bonded together, or it may be applied as the final step in the construction process. In either case, the same adhesive 24 may be used to bond the spall shield as was used to bond the other components.

As a general rule, most composite ceramic tile armor, including the present invention, is manufactured such that ceramic tile constitutes approximately two-thirds of the weight of the armor configuration, while the backing makes up approximately one-third of the weight. Because the density of ceramic is greater than that of laminate backing, it is also typical of armor constructions similar to the present invention that the ratio of thickness of the ceramic tile to the thickness of the backing approximates 1:1.

Precise dimensions of each component of the present invention will vary depending on the dimensions of the ceramic tiles whose joint areas 25 and free edge areas 26 they are intended to protect, and on the type of the ballistic threat the armor is meant to withstand. If the armor in FIGS. 1 and 2 is intended as protection against a caliber .30 threat, for example, the ceramic tile 20 could be approximately 0.32 inches in thickness, the laminate backing 21 approximately 0.25 inches in thickness, the overlay strip 22 approximately 0.060 to 0.125 inches in thickness, the spall shield layer 23 approximately 0.03 inches in thickness, and each of the three adhesive layers 24 approximately 0.03 inches in thickness. Total thickness of the present invention constructed to protect against a caliber .30 threat would therefore vary between approximately 0.75 and 0.815 inches. The specific thickness is dependent on the type (lead core, steel core, armor piercing, etc.) and velocity of the caliber .30 threat. Constructions of the present invention intended as protection against other ballistic threats may-be of greater or lesser overall thickness, but the thicknesses of the separate components relative to one another would remain proportionally similar to those in the above example.

Lengths and widths of the overlay strips 22 will likewise vary according to the dimensions of the specific ceramic tile configuration whose joint areas 25 and free-edge areas 26 they are intended to protect. If the overlay strip configuration in FIG. 3 is intended as protection against a caliber .30 threat, for example, and each ceramic tile 20 in the configuration measures 4 inches×4 inches, overlay strips 22*a* are cut to 1 inch in width and bonded over joint seams 25 so that approximately 50 percent of their width covers either side of the seam. Overlay strips 22*b*, to protect the free edges, are cut to 0.5 inches in width and bonded to the underlying tile 20 in direct alignment to the length of the free edge, with no overhanging lap or exposed tile surface between the edge and the overlaying strip.

One preferred method for producing the overlay strip protection is illustrated in FIG. 3, wherein broken lines represent underlying tile joint seams 25. Individually cut overlay strips are bonded with adhesive lengthwise across the configuration, from side B to side C, in one continuous piece. Individual strips applied and bonded between these longer strips, from side A to side D, are equal to the remaining length of the tile joint or edge requiring protection.

FIG. 4 shows another preferred method of producing the overlay strip protection. With this method, the protection is a unitary reinforcement frame of overlay strip material 22 positioned and bonded with adhesive to the underlying ceramic tile 20. This method is particularly advantageous in the high-volume production of ceramic armor configurations of identical dimensions.

While in accordance with patent statutes the preferred embodiment of the invention has been illustrated and described in detail, it is to be understood that the invention is not limited thereto or thereby, but that the scope of the invention will be defined in the claims.

What I claim is:

1. A ceramic armor system comprising:

(a) a laminate backing having a front surface;

(b) a plurality of ceramic tiles, each tile having a front surface, a back surface and edges, wherein the edges of adjacent tiles form tile joints, and wherein the ceramic tiles are bonded to the front surface of the laminate backing;

(c) overlay strips, each having a substantially rectangular cross-section, bonded over the tile joints on the front surface of the tiles; and (d) a spall shield bonded over the ceramic tiles and the overlay strips, wherein the laminate backing is comprised of a plurality of layers of fiber-reinforced laminates.

2. The ceramic armor system of claim 1, wherein the ceramic tiles are selected from aluminum oxide, silicon carbide and boron carbide ceramic tiles.

3. The ceramic armor system of claim 1, wherein the laminate backing is comprised of fiberglass fiber-reinforced laminate in a resin matrix.

4. The ceramic armor system of claim 1, wherein the laminate backing is comprised of aramid fiber reinforced laminate in a resin matrix.

5. The ceramic armor system of claim 1, wherein the laminate backing is comprised of polyethylene fiber reinforced laminate in a resin matrix.

6. The ceramic armor system of claim 5, wherein the matrix is a polyester matrix.

7. The ceramic armor system of claim 5, wherein the matrix is an epoxy matrix.

8. The ceramic armor system of claim 5, wherein the matrix is a phenolic matrix.

9. The ceramic armor system of claim 1, wherein the laminate backing comprises a resin matrix and the resin matrix is a vinylester matrix.

10. The ceramic armor system of claim 1, wherein the overlay strips are selected from aluminum oxide, silicon carbide and boron carbide strips.

11. The ceramic armor system of claim 1, wherein the spall shield is comprised of nylon fabric.

12. The ceramic armor system of claim 1, wherein the spall shield is comprised of aramid fabric.

13. The ceramic armor system of claim 1, wherein the spall shield is comprised of urethane resin film.

14. The ceramic armor system of claim 1, wherein the ceramic tile is bonded to the laminate backing using a resin adhesive.

15. The ceramic armor system of claim 14, wherein the ceramic tile is bonded to the laminate backing using a urethane adhesive.

16. The ceramic armor system of claim 1, wherein the overlay strips form a unitary reinforcement frame.

17. The ceramic armor system of claim 1, wherein the ratio of the thickness of the ceramic tile to the laminate backing is approximately 1:1.

18. A ceramic armor system comprising:

(a) a plurality of ceramic matrix composite tiles, each tile having a front surface, a back surface and edges, wherein the edges of adjacent tiles form tile joints;

(b) a laminate backing bonded to the back surface of the ceramic tiles using a resin adhesive;

(c) overlay strips, each having a substantially rectangular cross-section, on the front surfaces of the tiles bonded to the ceramic tiles over the tile joints; and (d) a spall shield bonded over the ceramic tiles and the overlay strips;

wherein the laminate backing is comprised of a plurality of layers of fiber-reinforced laminates.

19. The ceramic armor system of claim 18, wherein the laminate backing is comprised of a fiber-reinforced resin matrix.

20. The ceramic armor system of claim 18, wherein the overlay strips are selected from aluminum oxide, silicon carbide and boron carbide strips.

21. The ceramic armor system of claim 18, wherein the spall shield is comprised of nylon fabric.

22. The ceramic armor system of claim 18, wherein the spall shield is comprised of aramid film.

23. The ceramic armor system of claim 18, wherein the spall shield is comprised of urethane resin film.

24. The ceramic armor system of claim 18, wherein the ceramic tile is bonded to the laminate backing using a resin adhesive.

25. The ceramic armor system of claim 18, wherein the overlay strips form a unitary reinforcement frame.

26. The ceramic armor system of claim 18, wherein the ratio of the thickness of the ceramic tile to the laminate backing is approximately 1:1.

* * * * *

UNITED STATES PATENT AND TRADEMARK OFFICE

CERTIFICATE OF CORRECTION

PATENT NO. : 6,332,390 B1
DATED : December 25, 2001
INVENTOR(S) : Lyons

It is certified that error appears in the above-identified patent and that said Letters Patent is hereby corrected as shown below:

Column 5,
Line 12, "wherein the laminate backing is comprised of a plurality of layers of fiber-reinforced laminates" should start on a new line.

Signed and Sealed this

Twenty-third Day of April, 2002

*Attest:*

*Attesting Officer*

JAMES E. ROGAN
*Director of the United States Patent and Trademark Office*